US008442838B2

(12) United States Patent
Kuo et al.

(10) Patent No.: US 8,442,838 B2
(45) **Date of Patent: *May 14, 2013**

(54) BITRATE CONSTRAINED VARIABLE BITRATE AUDIO ENCODING

(75) Inventors: Shyh-Shiaw Kuo, Cupertino, CA (US); Hong Kaura, Sunnyvale, CA (US); William G. Stewart, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/031,963

(22) Filed: Feb. 22, 2011

(65) Prior Publication Data

US 2011/0145004 A1 Jun. 16, 2011

Related U.S. Application Data

(63) Continuation of application No. 12/610,615, filed on Nov. 2, 2009, now Pat. No. 7,895,045, which is a continuation of application No. 11/067,080, filed on Feb. 25, 2005, now Pat. No. 7,634,413.

(51) Int. Cl.
*G10L 19/00* (2006.01)
*G10L 19/02* (2006.01)

(52) U.S. Cl.
USPC ..... 704/501; 704/229

(58) Field of Classification Search ..... None
See application file for complete search history.

(56) References Cited

U.S. PATENT DOCUMENTS

| | | | |
|---|---|---|---|
| 5,845,243 | A | 12/1998 | Smart et al. |
| 6,330,532 | B1 | 12/2001 | Manjunath et al. |
| 7,003,449 | B1 | 2/2006 | Absar et al. |
| 7,027,982 | B2 | 4/2006 | Chen et al. |
| 7,062,445 | B2 | 6/2006 | Kadatch |
| 7,343,291 | B2 | 3/2008 | Thumpudi et al. |
| 2004/0230425 | A1 | 11/2004 | Yu et al. |

OTHER PUBLICATIONS

ISO/IEC FCD 14496-3 Subpart 4, May 15, 1998: In: Information Technology—Coding of Audiovisual Objects, 4 files.

Grill, B. et al., ISO/IEC FCD 14996-3 Subpart 1, May 15, 1998. In: Information Technology—Very Low Bitrate Audio-Visual Coding.

*Primary Examiner* — Brian Albertalli

(74) *Attorney, Agent, or Firm* — Blakely, Sokoloff, Taylor & Zafman LLP

(57) ABSTRACT

A hybrid audio encoding technique incorporates both ABR, or CBR, and VBR encoding modes. For each audio coding block, after a VBR quantization loop meets the NMR target, a second quantization loop might be called to adaptively control the final bitrate. That is, if the NMR-based quantization loop results in a bitrate that is not within a specified range, then a bitrate-based CBR or ABR quantization loop determines a final bitrate that is within the range and is adaptively determined based on the encoding difficulty of the audio data. Excessive bitrates from use of conventional VBR mode are eliminated, while still providing much more constant perceptual sound quality than use of conventional CBR mode can achieve.

27 Claims, 4 Drawing Sheets

BITRATE CONSTRAINED VARIABLE BITRATE AUDIO ENCODING

BENEFIT CLAIM; CROSS-REFERENCE TO RELATED APPLICATIONS

This application is a continuation of U.S. patent application Ser. No. 12/610,615, filed Nov. 2, 2009, entitled "Bitrate Constrained Variable Bitrate Audio Encoding", which is a continuation of U.S. patent application Ser. No. 11/067,080, filed Feb. 25, 2005, entitled "Bitrate Constrained Variable Bitrate Audio Encoding", now U.S. Pat. No. 7,634,413, the entire contents of each of which is hereby incorporated by reference as if fully set forth herein, under 35 U.S.C. §120. The applicant(s) hereby rescind any disclaimer of claim scope in the parent applications or the prosecution history thereof and advise the USPTO that the claims in this application may be broader than any claim in the parent applications.

TECHNICAL FIELD

The present invention relates generally to digital audio processing and, more specifically, to techniques for bitrate constrained variable bitrate audio encoding.

BACKGROUND

Audio coding, or audio compression, algorithms are used to obtain compact digital representations of high-fidelity (i.e., wideband) audio signals for the purpose of efficient transmission and/or storage. The central objective in audio coding is to represent the signal with a minimum number of bits while achieving transparent signal reproduction, i.e., while generating output audio which cannot be humanly distinguished from the original input, even by a sensitive listener.

Advanced Audio Coding ("AAC") is a wideband audio coding algorithm that exploits two primary coding strategies to dramatically reduce the amount of data needed to convey high-quality digital audio. Signal components that are "perceptually irrelevant" and can be discarded without a perceived loss of audio quality are removed. Further, redundancies in the coded audio signal are eliminated. Hence, efficient audio compression is achieved by a variety of perceptual audio coding and data compression tools, which are combined in the MPEG-4 AAC specification. The MPEG-4 AAC standard incorporates MPEG-2 AAC, forming the basis of the MPEG-4 audio compression technology for data rates above 32 kbps per channel. Additional tools increase the effectiveness of AAC at lower bit rates, and add scalability or error resilience characteristics. These additional tools extend AAC into its MPEG-4 incarnation (ISO/IEC 14496-3, Subpart 4).

AAC is referred to as a perceptual audio coder, or lossy coder, because it is based on a listener perceptual model, i.e., what a listener can actually hear, or perceive. The two basic bitrate modes for audio coding, such as AAC, are CBR (constant bitrate) and VBR (variable bitrate). Unlike CBR, in which bitrates are strictly constant at each instance, ABR (average bitrate) allows a small variation of bitrates for each instance while maintaining a certain average bitrate for the entire track, thereby resulting in a reasonably predictable size to the finished files.

A CBR codec is constant in bitrate along an audio time signal, but variable in sound quality. For example, for stereo encoding at a bitrate of 96 kb/s, an encoded speech track, which is "easy' to encode due to its relatively narrow frequency bandwidth, sounds indistinguishable from the original source of the track. However, noticeable artifacts could be heard in similarly encoded complex classical music, which is "difficult" to encode due to a typically broad frequency bandwidth and, therefore, more data to encode. CBR is important to bitrate critical applications, such as audio streaming, but the variable sound quality produced makes CBR undesirable for other offline applications.

A VBR codec is targeted to produce audio having constant quality by using as many bits for encoding as are needed to meet a sound quality target. In other words, the bitrate varies depending on the difficulty associated with encoding a given audio track, with a goal of constant perception of the sound quality along the entirety of the audio stream. With VBR, the sound quality target is typically defined by the Noise-to-Masking Ratio ("NMR"), which is calculated for each block of audio data based on the psychoacoustic model used in the coder. Because the coding bitrate of a VBR codec may vary significantly, VBR is not always suitable for bitrate critical applications.

Simultaneous Masking is a frequency domain phenomenon where a low level signal, e.g., a smallband noise (the maskee) can be made inaudible by a simultaneously occurring stronger signal (the masker). A masking threshold can be measured below which any signal will not be audible. The masking threshold depends on the sound pressure level (SPL) and the frequency of the masker, and on the characteristics of the masker and maskee. If the source signal consists of many simultaneous maskers, a global masking threshold can be computed that describes the threshold of just noticeable distortions as a function of frequency. The most common way of calculating the global masking threshold is based on the high resolution short term amplitude spectrum of the audio or speech signal.

Coding audio based on the psychoacoustic model only encodes audio signals above a masking threshold, block by block of audio. Therefore, if distortion (typically referred to as quantization noise), which is inherent to an amplitude quantization process, is under the masking threshold, a typical human cannot hear the noise. A sound quality target is based on a subjective perceptual quality scale (e.g., from 0-5, with 5 being best quality). From an audio quality target on this perceptual quality scale, a noise profile, i.e., an offset from the applicable masking threshold, is determinable. This noise profile represents the level at which quantization noise can be masked, while achieving the desired quality target. From the noise profile, an appropriate coding quantization step is determinable. The quantization step is directly related to the coding bitrate.

A practical problem with a VBR codec is that the bitrate used to encode some tracks will be either too high (i.e., bits wasted) or too low (i.e., diminished perceptual quality). This phenomenon is due in part to the nature of the track, i.e., the ease or difficulty of encoding the track. However, this phenomenon is mainly due to the fact that current technology has simply not achieved a perfect psychoacoustic model because the understanding of human hearing is still limited. A consequence is inaccurate masking thresholds for targeting sound quality. In addition, the perceived sound quality is not solely dependent on the masking thresholds. Hence, even if a perfect psycho-model existed for generating accurate masking thresholds, the sound quality target derived from the masking threshold (e.g., NMR) still cannot perfectly match what is actually perceived.

Based on the foregoing, there is room for improvement in audio coding techniques.

The techniques described in this section are techniques that could be pursued, but not necessarily techniques that have been previously conceived or pursued. Therefore, unless otherwise indicated, it should not be assumed that any of the techniques described in this section qualify as prior art merely by virtue of their inclusion in this section.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Figure 1:
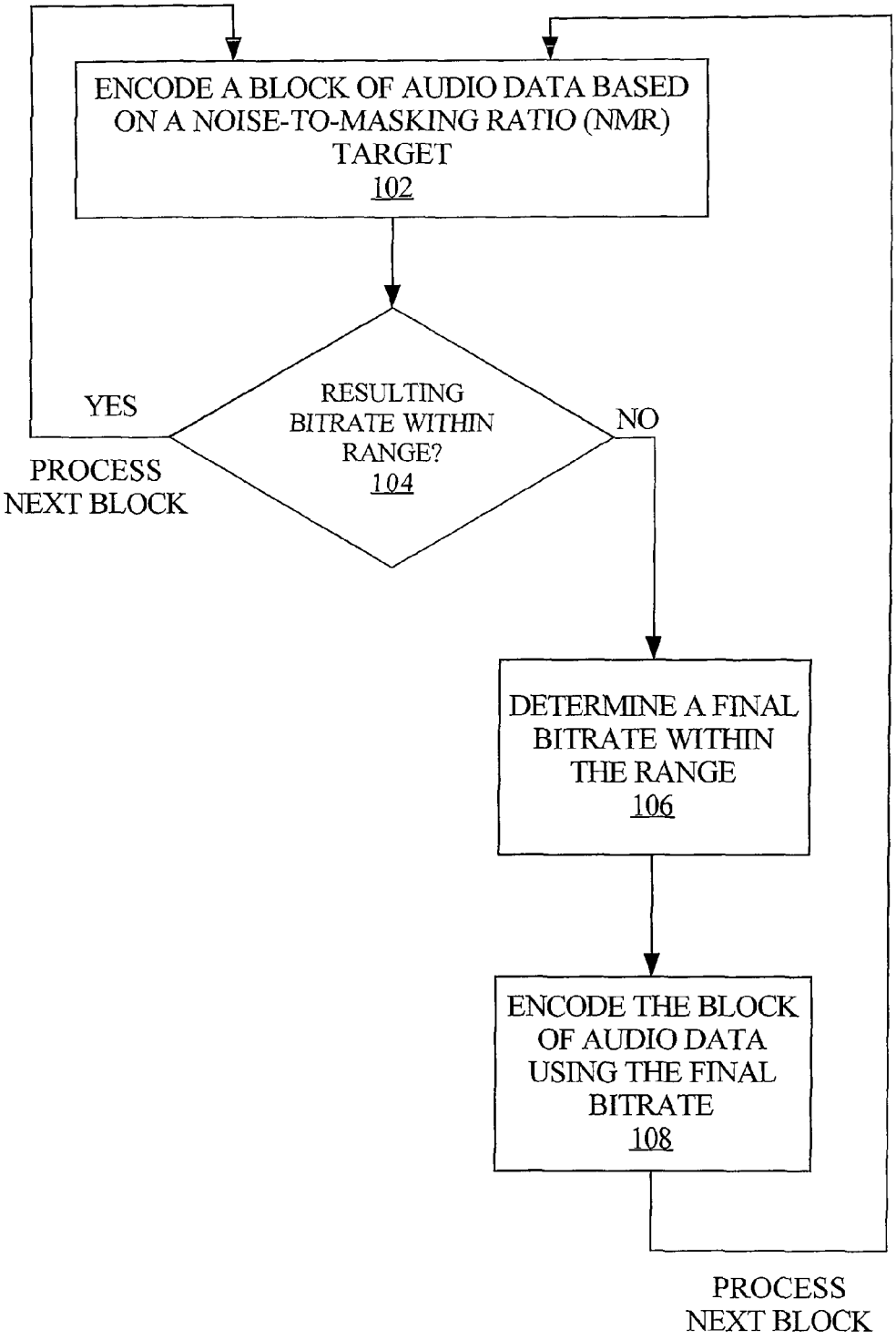
FIG. 1 is a flow diagram that illustrates a method for the bitrate constrained VBR encoding which encodes a block of audio, according to an embodiment of the invention.

In the following description, for the purposes of explanation, numerous specific details are set forth in order to provide a thorough understanding of embodiments of the present invention. It will be apparent, however, that embodiments of the present invention may be practiced without these specific details. In other instances, well-known structures and devices are shown in block diagram form in order to avoid unnecessarily obscuring embodiments of the present invention.

Functional Overview

Bitrate constrained variable bitrate coding incorporates both ABR, or CBR, and VBR encoding modes to meet different audio coding requirements. The hybrid implementation of VBR can be applied, for example, to MPEG-2 and MPEG-4 AAC codecs.

In one embodiment of the invention, for each audio coding block, after a VBR quantization loop meets the NMR target, a second quantization loop might be called to adaptively control the final bitrate. That is, if the NMR-based quantization loop results in a bitrate that is not within a specified range, then an appropriate bitrate is adaptively determined and an ABR or CBR quantization loop is executed to meet this bitrate. The audio block can then be encoded using a quantization step that corresponds to the final bitrate.

Hence, for scenarios in which bits are wasted through use of a conventional VBR coder that results in excessively high bitrates and, therefore, sound quality that is unduly high compared to the desirable target, embodiments of the invention decrease the bitrate and still meet the desirable sound quality target. For scenarios in which use of a conventional VBR coder would result in unduly low bitrates and, therefore, sound quality that is far from the desirable target, the described embodiments of the invention increase the bitrate in order to meet the desirable sound quality target. Hence, a more efficient, quality-stable audio coding technique is provided, with which excessive bitrates from use of conventional VBR mode are eliminated, while still providing much more constant perceptual sound quality than use of conventional CBR mode can achieve.

Perceptual sound quality cannot be solely determined based on the Noise-to-Masking Ratio. Hence, even if a perfect psychoacoustic model existed for generating accurate masking thresholds, the sound quality target based on the NMR still does not perfectly match what humans perceive.

Bitrate constrained variable bitrate coding is described, which incorporates both CBR (or Average Bit Rate) and VBR encoding modes to meet different audio coding requirements. The hybrid implementation of VBR exploits that fact that coding bitrate and the resulting sound quality are highly correlated. That is, higher bitrate coding results in higher sound quality and lower bitrate coding results in lower sound quality.

In one embodiment of the invention, for each audio coding block, after a quantization loop meets the NMR target, a second quantization loop might be called to adaptively control the final bitrate. That is, if the NMR-based quantization loop results in a bitrate that is not within a specified range, then an appropriate bitrate is adaptively determined based on the encoding difficulty of the block and the fullness of a bit reservoir. An ABR or CBR quantization loop is executed to meet this bitrate.

A Method for Determining a Bitrate for Encoding a Block of Audio

FIG. 1 is a flow diagram that illustrates a method for determining a bitrate at which to encode a block of audio, according to an embodiment of the invention. The method illustrated in FIG. 1 is performed by one or more electronic computing devices, for non-limiting examples, a computer system like computer system 300 of FIG. 3, a portable electronic device such as a digital music player, personal digital assistant, and the like. Further, the method may be integrated into other audio or multimedia applications that execute on an electronic computing device, such as media authoring and playback applications.

At block 102, a block of audio is encoded, based on a NMR target for the block of audio. In one embodiment of the invention, an audio stream (comprising multiple blocks of audio data) is processed by executing a conventional VBR noise quantization loop to achieve the target NMR corresponding to the audio signal represented by the coding block, in accordance with the target perceptual quality level.

If the block was encoded using a quantization step that is outside of a specified range, bits could be wasted through use of an excessively high bitrate for the desired perceptual sound quality, or the quality could be unacceptably diminished through use of an excessively low bitrate. Hence, at decision block 104, it is determined whether the resulting bitrate falls within a specified range. In one embodiment of the invention, the specified range encompasses a target bitrate. For a non-limiting example, the target bitrate may be 128 kb/s, with an associated range from 10% below the target to 15% above the target.

Figure 2A:
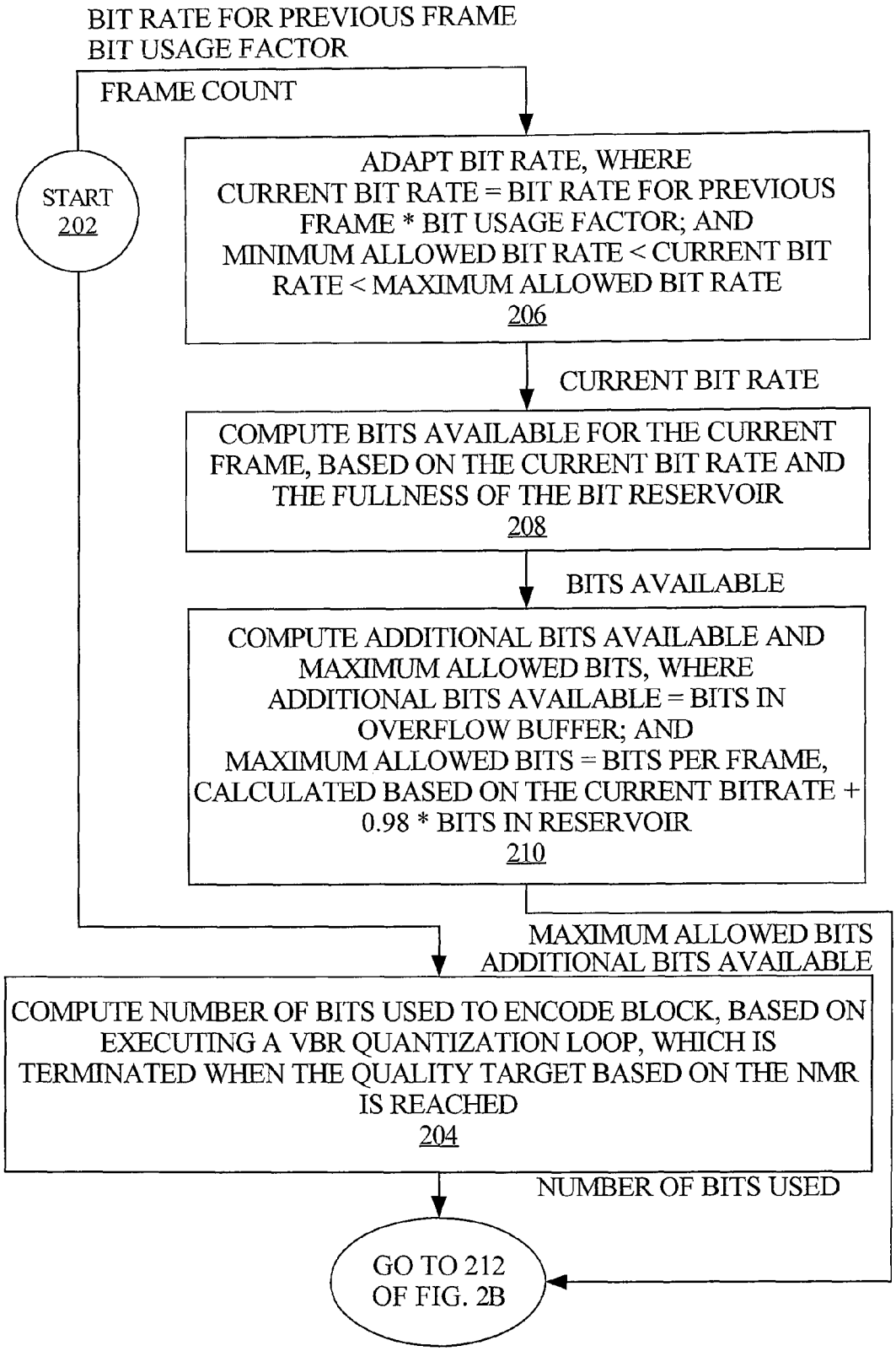
FIG. 2A is a flow diagram that illustrates a method for adaptively determining the number of bits to use to encode a block of audio, according to an embodiment of the invention.
Figure 2B:
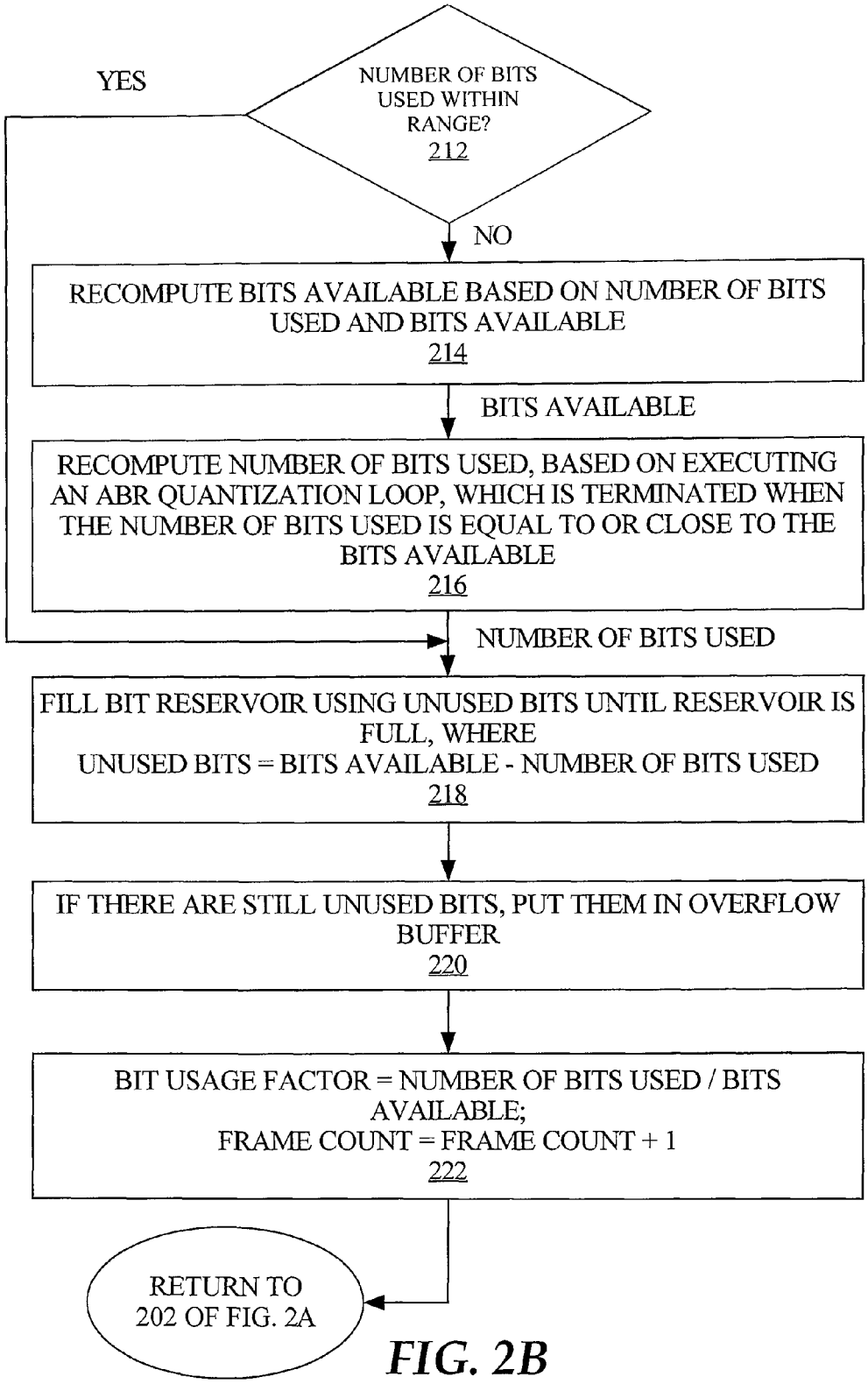
FIG. 2B is continuation of the flow diagram of FIG. 2A, which illustrates a method for adaptively determining the number of bits to use to encode a block of audio, according to an embodiment of the invention.

In one embodiment of the invention, the target bitrate is based on (1) the bitrate at which the prior block, from the same audio stream or file, was encoded; and (2) the fullness of a bit reservoir, as described in reference to FIGS. 2A and 2B.

If the candidate bitrate falls within the specified range, then the coding process can then pass control back to block 102 for processing the next audio block.

If the candidate bitrate does not fall within the specified range, then at block 106, a final bitrate at which to encode the audio block is determined. The final bitrate is based on the target bitrate (e.g., the bits available as described in reference to FIGS. 2A and 2B), and falls within the specified range. In one embodiment of the invention, a modified VBR noise quantization loop is executed to reach the target bitrate rather than the NMR, as with the previous quantization loop. In other words, the modified VBR noise quantization loop is executed to reach the quantization step corresponding to the final bitrate. In a related embodiment of the invention, the modified VBR noise quantization loop is an ABR quantization loop. It is possible that the final bitrate violates the NMR, however, the final bitrate is ensured of falling within the specified range.

In one embodiment of the invention, if the resulting bitrate, from the first VBR loop, is greater than the highest value in the specified range, then determining the final bitrate includes adjusting the final quantization step using the modified quantization loop, so that the final bitrate is the sum of the target bitrate and a specified percentage of the difference between the candidate bitrate and the target bitrate. Similarly, if the resulting bitrate is less than the lowest value in the specified range, then determining the final bitrate includes adjusting the final quantization step using the modified quantization loop, so that the final bitrate is the difference between the target bitrate and a specified percentage of the difference between the target bitrate and the candidate bitrate. Consequently, the final bitrate is ensured to be between the resulting bitrate and the target bitrate, and be within the specified range.

At block 108, the block of audio can be encoded using the final bitrate, or in other words, the quantization step corresponding to the final bitrate. Consequently, encoding the entire audio stream using the method illustrated in FIG. 1 results in a smaller overall dynamic range of VBR coding bitrate, however, with the perceptual quality approaching a constant.

A Method for Determining a Number of Bits to Use to Encode a Block of Audio

FIGS. 2A and 2B are a flow diagram that illustrates a method for determining a number of bits to use to encode a block of audio, according to an embodiment of the invention. The method illustrated in FIGS. 2A and 2B is performed by one or more electronic computing devices, for non-limiting examples, a computer system like computer system 300 of FIG. 3, a portable electronic device such as a digital music player, personal digital assistant, and the like. Further, the method may be integrated into other audio or multimedia applications that execute on an electronic computing device, such as media authoring and playback applications.

In one embodiment of the invention, the method of FIGS. 2A and 2B is performed in the context of encoding audio in accordance with the MPEG-4 AAC specification. However, the context in which the following method is performed may vary from implementation to implementation and, therefore, is not limited to use with MPEG-4 AAC encoding schemes.

In the context of the method of FIGS. 2A and 2B, a block of audio refers to multiple samples. For example, a block representing 2048 audio PCM (pulse-code modulation) samples may be MDCT (modified discrete cosine transform) transformed to a block representing 1024 MDCT samples.

At block 202, the method of FIGS. 2A and 2B is initialized with (1) a block count equal to 0, (2) a bitrate for previous block equal to a target bitrate (e.g., 128 kb/s), and (3) a bit usage factor equal to 1.0.

At block 204, the number of bits used to encode the block is computed based on executing a VBR (variable bit rate) quantization loop which encodes the audio block. The VBR quantization loop is terminated when the perceptual quality target, which is based on the NMR (noise-to-masking ratio), is reached. The actual number of bits used by the VBR quantization loop is calculated and control can pass to block 212 of FIG. 2B.

At block 206, an adaptive bitrate determination process is started, by computing a current bitrate. The current bitrate is computed as the product of the bitrate for previous block and the bit usage factor. The manner in which the adaptive bitrate determination is implemented may vary from implementation to implementation. Therefore, blocks 206, 208, 210 may be performed concurrently with block 204, or sequentially with block 204. At block 206, for the first audio block being processed, the current bitrate is equal to the target bitrate, which is 128 kb/s for this example. Further, the current bitrate is constrained to be less than a maximum allowed bitrate and greater than a minimum allowed bitrate. The minimum and maximum allowed bitrates define a range within which the number of bits used to encode the block must lie, in order to ensure near constant perceptual quality in a bit-efficient manner.

At block 208, the number of bits available for encoding the block is computed based on the current bit rate (from block 206) and the fullness of the bit reservoir.

At block 210, (1) the number of additional bits available and (2) the maximum number of allowed bits are computed. The number of additional bits available is computed as equal to the number of bits in an overflow buffer used in encoding the audio. The maximum number of allowed bits is computed as equal to the sum of the number of bits per block (calculated based on the current bitrate) and a percentage of the number of bits in the bit reservoir. In one embodiment of the invention, the percentage used is 98%, in order to ensure that the bit reservoir is not completely depleted. Once block 210 is completed, control can pass to block 212 of FIG. 2B.

At decision block 212 (FIG. 2B), it is determined whether or not the resulting number of bits used by the VBR quantization loop (block 204 of FIG. 2A) to encode the block of audio is within a range of allowed bits. If the number of bits used is too many or too few, then the bits available is adapted for input to an ABR quantization loop, i.e., control is passed to block 214 of FIG. 2B. If the number of bits used is within the range, encoding of this block of audio data is completed and blocks 214, 216 (FIG. 2B) are not needed. Control can pass to block 218 of FIG. 2B.

Generally, if the resulting number of bits used from the VBR loop is too many, then it is more likely that the NMR target is just not able to correctly reflect the desirable quality; however, it also means that this block of audio is difficult to encode. Therefore, some extra bits will be allocated, but not as many extra bits as the VBR loop requested (e.g., =Number of bits used−bits available calculated at block 208 of FIG. 2A). Similarly, if the resulting number of bits used in the VBR loop is too few, then it is more likely that the NMR target is just not able to correctly reflect the desirable quality; however, it also means this block of audio is very easy to encode. Therefore, the allocated bits for this block will be reduced, but not by as many as the VBR loop indicated (e.g., =bits available calculated at block 208 of FIG. 2A−number of bits used).

In one embodiment of the invention, if the number of bits used is not within the range (i.e., decision block 212 is negative), then the number of bits available is recomputed at block 214. The number of bits available is recomputed, generally, based on the number of bits used (from the VBR quantization loop at block 204) and the overall number of bits available (e.g., with consideration to the additional bits available and maximum allowed bits, from block 210, and bits available from block 208).

Recomputation of the number of bits available may be based on the following example pseudo-code.

```
if (number of bits used > min(bits available + additional bits available),
maximum allowed bits)
{
    bits available = bits available + alpha * (number of bits used – bits
    available)
}
else if (number of bits used < (0.9 * bits available)
{
    bits available = bits available + beta * (number of bits used – bits
    available)
}
else
{
    GOTO VBR_DONE
};
```

where VBR_DONE is illustrated as blocks 218 and 220 of FIG. 2B. In one implementation, alpha is equal to 0.5 and beta is equal to 0.1, values found through experimentation to be reasonable and to work well.

At block 216, the new number of bits available is used to recompute the number of bits used, by executing an ABR (or CBR, according to an embodiment of the invention) quantization loop. The ABR loop terminates when the number of bits used is equal to or substantially close to the new number of bits available, from block 214. Generally, the idea is to terminate the ABR loop when all the bits allocated (e.g., bits available) are used. However, the increment of actual bit usage is normally not one bit, so the exact number of bits available may not be reachable in practice. Hence, the ABR loop terminates when the actual bit usage and the bits available converges, e.g., when the difference between the actual bit usage and the bits available oscillates within a small range. Once the ABR loop terminates, the audio block is encoded and the final number of bits used to encode the audio block is calculated and output from block 216.

Once the number of bits used to encode the block is computed, in one embodiment of the invention, some post-processing is performed in support of determining the number of bits used to encode the next audio block. At block 218, unused bits are added, or allocated, to the bit reservoir up to the maximum capacity of the reservoir, if possible. In the context of MPEG-4 AAC, the size of the bit reservoir is specified by the MPEG standard. The number of unused bits is equal to the difference of the bits available and the number of bits used, with respect to the block currently being processed. If there are still unused bits available after filling the bit reservoir to capacity, then at block 220 these unused bits are allocated to the overflow buffer.

At block 222, input variables are recomputed, for processing the next audio block. The bit usage factor is computed as the number of bits used divided by the number of bits available. The block count is incremented by one. Control passes back to block 202 for processing the next block, with the new values for these variables, where the current bitrate is computed as the product of the bitrate for the previous block (i.e., the number of bits used that was just computed at block 216) and the new bit usage factor computed at block 222.

Hardware Overview

Figure 3:
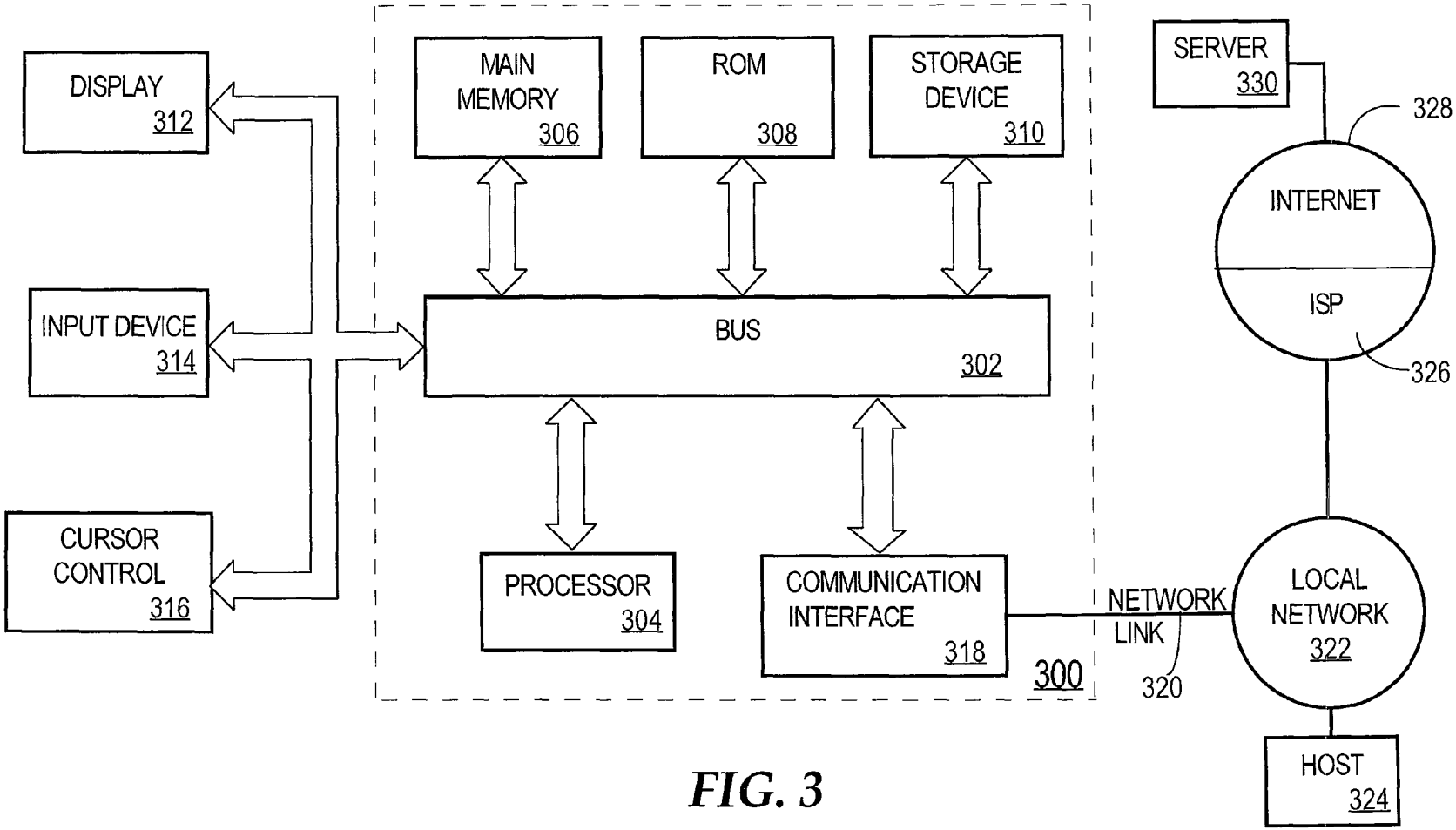
FIG. 3 is a block diagram that illustrates a computer system upon which an embodiment of the invention may be implemented.

FIG. 3 is a block diagram that illustrates a computer system 300 upon which an embodiment of the invention may be implemented. A computer system as illustrated in FIG. 3 is but one possible system on which embodiments of the invention may be implemented and practiced. For example, embodiments of the invention may be implemented on any suitably configured device, such as a handheld or otherwise portable device, a desktop device, a set-top device, a networked device, and the like, configured for containing and/or playing audio. Hence, all of the components that are illustrated and described in reference to FIG. 3 are not necessary for implementing embodiments of the invention.

Computer system 300 includes a bus 302 or other communication mechanism for communicating information, and a processor 304 coupled with bus 302 for processing information. Computer system 300 also includes a main memory 306, such as a random access memory (RAM) or other dynamic storage device, coupled to bus 302 for storing information and instructions to be executed by processor 304. Main memory 306 also may be used for storing temporary variables or other intermediate information during execution of instructions to be executed by processor 304. Computer system 300 further includes a read only memory (ROM) 308 or other static storage device coupled to bus 302 for storing static information and instructions for processor 304. A storage device 310, such as a magnetic disk or optical disk, is provided and coupled to bus 302 for storing information and instructions.

Computer system 300 may be coupled via bus 302 to a display 312, such as a cathode ray tube (CRT), for displaying information to a computer user. An input device 314, including alphanumeric and other keys, is coupled to bus 302 for communicating information and command selections to processor 304. Another type of user input device is cursor control 316, such as a mouse, a trackball, or cursor direction keys for communicating direction information and command selections to processor 304 and for controlling cursor movement on display 312. This input device typically has two degrees of freedom in two axes, a first axis (e.g., x) and a second axis (e.g., y), that allows the device to specify positions in a plane.

One or more embodiments of the invention are related to use of computer system 300 for implementing techniques described herein. According to one embodiment of the invention, those techniques are performed by computer system 300 in response to processor 304 executing one or more sequences of one or more instructions contained in main memory 306. Such instructions may be read into main memory 306 from another machine-readable medium, such as storage device 310. Execution of the sequences of instructions contained in main memory 306 causes processor 304 to perform the process steps described herein. In alternative embodiments, hard-wired circuitry may be used in place of or in combination with software instructions to implement one or more embodiments of the invention. Thus, embodiments of the invention are not limited to any specific combination of hardware circuitry and software.

The term "machine-readable medium" as used herein refers to any medium that participates in providing data that causes a machine to operation in a specific fashion. In an embodiment implemented using computer system 300, various machine-readable media are involved, for example, in providing instructions to processor 304 for execution. Such a medium may take many forms, including but not limited to, non-volatile media, volatile media, and transmission media. Non-volatile media includes, for example, optical or magnetic disks, such as storage device 310. Volatile media includes dynamic memory, such as main memory 306. Transmission media includes coaxial cables, copper wire and fiber optics, including the wires that comprise bus 302. Transmission media can also take the form of acoustic or light waves, such as those generated during radio-wave and infra-red data communications.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 304 for execution. For example, the instructions may initially be carried on a magnetic disk of a remote computer. The remote computer can load the instructions into its dynamic memory and send the instructions over a telephone line using a modem. A modem local to computer system 300 can receive the data on the telephone line and use an infra-red transmitter to convert the data to an infra-red signal. An infra-red detector can receive the data carried in the infra-red signal and appropriate circuitry can place the data on bus 302. Bus 302 carries the data to main memory 306, from which processor 304 retrieves and executes the instructions. The instructions received by main memory 306 may optionally be stored on storage device 310 either before or after execution by processor 304.

Computer system 300 also includes a communication interface 318 coupled to bus 302. Communication interface 318 provides a two-way data communication coupling to a network link 320 that is connected to a local network 322. For example, communication interface 318 may be an integrated services digital network (ISDN) card or a modem to provide a data communication connection to a corresponding type of telephone line. As another example, communication interface 318 may be a local area network (LAN) card to provide a data communication connection to a compatible LAN. Wireless links may also be implemented. In any such implementation, communication interface 318 sends and receives electrical, electromagnetic or optical signals that carry digital data streams representing various types of information.

Network link 320 typically provides data communication through one or more networks to other data devices. For example, network link 320 may provide a connection through local network 322 to a host computer 324 or to data equipment operated by an Internet Service Provider (ISP) 326. ISP 326 in turn provides data communication services through the world wide packet data communication network now commonly referred to as the "Internet" 328. Local network 322 and Internet 328 both use electrical, electromagnetic or optical signals that carry digital data streams. The signals through the various networks and the signals on network link 320 and through communication interface 318, which carry the digital data to and from computer system 300, are exemplary forms of carrier waves transporting the information.

Computer system 300 can send messages and receive data, including program code, through the network(s), network link 320 and communication interface 318. In the Internet example, a server 330 might transmit a requested code for an application program through Internet 328, ISP 326, local network 322 and communication interface 318. The received code may be executed by processor 304 as it is received, and/or stored in storage device 310, or other non-volatile storage for later execution. In this manner, computer system 300 may obtain application code in the form of a carrier wave.

Extensions and Alternatives

Alternative embodiments of the invention are described throughout the foregoing description, and in locations that best facilitate understanding the context of such embodiments. Furthermore, the invention has been described with reference to specific embodiments thereof. It will, however, be evident that various modifications and changes may be made thereto without departing from the broader spirit and scope of the invention. Therefore, the specification and drawings are, accordingly, to be regarded in an illustrative rather than a restrictive sense.

In addition, in this description certain process steps are set forth in a particular order, and alphabetic and alphanumeric labels may be used to identify certain steps. Unless specifically stated in the description, embodiments of the invention are not necessarily limited to any particular order of carrying out such steps. In particular, the labels are used merely for convenient identification of steps, and are not intended to specify or require a particular order of carrying out such steps.

What is claimed is:

1. A method for encoding audio, the method comprising:

receiving a series of blocks of audio data to encode;

encoding a particular block of audio data in the series at a first bitrate;

prior to encoding any block that follows the particular block in the series, determining whether the first bitrate is within a range, determining a target bitrate based on a bitrate at which a previous block of audio data in the series was encoded, in response to determining that the first bitrate is not within the range, determining a second bitrate within the range based on the target bitrate, and encoding the particular block of audio data at the second bitrate that is within the range;

wherein the method is performed by one or more computing devices.

2. The method of claim 1, wherein encoding the particular block of audio data at the first bitrate includes adjusting a first quantization step, using a first quantization loop, so that the first bitrate achieves a sound quality target.

3. The method of claim 2, wherein the second bitrate violates the sound quality target.

4. The method of claim 2, wherein the sound quality target is a noise-to-masking ratio target.

5. The method of claim 1, wherein encoding the particular block of audio data at the second bitrate includes adjusting a second quantization step, using a second quantization loop, so that the second bitrate is within the range.

6. The method of claim 1, wherein the range has a highest value and a lowest value, the method further comprising:

if the first bitrate is greater than the highest value in the range, then the second bitrate is the sum of the target bitrate and a first percentage of the difference between the first bitrate and the target bitrate;

if the first bitrate is less than the lowest value in the range, then the second bitrate is the difference between the target bitrate and a second percentage of the difference between the target bitrate and the first bitrate.

7. The method of claim 6, wherein the first percentage and the second percentage are different.

8. The method of claim 1, wherein the particular block of audio data has an immediately previous block of audio data in the series; and wherein the previous block is the immediately previously block.

9. The method of claim 1, further comprising:

encoding the particular block of audio data at the second bitrate based on a ratio of a number of bits used to encode the previous block and a number of bits available to encode the previous block.

10. A non-transitory computer-readable medium having processor-executable instructions recorded thereon for encoding audio, the instructions, when executed by one or more processors, cause performance of a method comprising:

receiving a series of blocks of audio data to encode;

encoding a particular block of audio data in the series at a first bitrate;

prior to encoding any block that follows the particular block in the series, determining whether the first bitrate is within a range, determining a target bitrate based on a bitrate at which a previous block of audio data in the series was encoded, in response to determining that the first bitrate is not within the range, determining a second bitrate within the range based on the target bitrate, and encoding the particular block of audio data at the second bitrate that is within the range.

11. The medium of claim 10, wherein the instructions for encoding the particular block of audio data at the first bitrate include instructions for adjusting a first quantization step, using a first quantization loop, so that the first bitrate achieves a sound quality target.

12. The medium of claim 11, wherein the second bitrate violates the sound quality target.

13. The medium of claim 11, wherein the sound quality target is a noise-to-masking ratio target.

14. The medium of claim 10, wherein the instructions for encoding the particular block of audio data at the second bitrate include instructions for adjusting a second quantization step, using a second quantization loop, so that the second bitrate is within the range.

15. The medium of claim 10, wherein the range has a highest value and a lowest value, the instructions further comprising instructions for:

if the first bitrate is greater than the highest value in the range, then the second bitrate is the sum of the target bitrate and a first percentage of the difference between the first bitrate and the target bitrate;

if the first bitrate is less than the lowest value in the range, then the second bitrate is the difference between the target bitrate and a second percentage of the difference between the target bitrate and the first bitrate.

16. The medium of claim 15, wherein the first percentage and the second percentage are different.

17. The medium of claim 10, wherein the particular block of audio data has an immediately previous block of audio data in the series; and wherein the previous block is the immediately previously block.

18. The medium of claim 10, further comprising instructions for:

encoding the particular block of audio data at the second bitrate based on a ratio of a number of bits used to encode the previous block and a number of bits available to encode the immediately previous block.

19. A computing device comprising an audio encoder, the audio encoder comprising logic for:

receiving a series of blocks of audio data to encode;

encoding a particular block of audio data in the series at a first bitrate;

prior to encoding any block that follows the particular block in the series, determining whether the first bitrate is within a range, determining a target bitrate based on a bitrate at which a previous block of audio data in the series was encoded, in response to determining that the first bitrate is not within the range, determining a second bitrate within the range based on the target bitrate, and encoding the particular block of audio data at the second bitrate that is within the range.

20. The device of claim 19, wherein the logic for encoding the particular block of audio data at the first bitrate includes logic for adjusting a first quantization step, using a first quantization loop, so that the first bitrate achieves a sound quality target.

21. The device of claim 20, wherein the second bitrate violates the sound quality target.

22. The device of claim 20, wherein the sound quality target is a noise-to-masking ratio target.

23. The device of claim 19, wherein the logic for encoding the particular block of audio data at the second bitrate includes logic for adjusting a second quantization step, using a second quantization loop, so that the second bitrate is within the range.

24. The device of claim 19, wherein the range has a highest value and a lowest value, the audio encoder further comprising logic for:

if the first bitrate is greater than the highest value in the range, then the second bitrate is the sum of the target bitrate and a first percentage of the difference between the first bitrate and the target bitrate;

if the first bitrate is less than the lowest value in the range, then the second bitrate is the difference between the target bitrate and a second percentage of the difference between the target bitrate and the first bitrate.

25. The device of claim 24, wherein the first percentage and the second percentage are different.

26. The device of claim 19, wherein the particular block of audio data has an immediately previous block of audio data in the series; and wherein the previous block is the immediately previously block.

27. The device of claim 19, the audio encoder further comprising logic for:

encoding the particular block of audio data at the second bitrate based on a ratio of a number of bits used to encode the previous block and a number of bits available to encode the previous block.

* * * * *